United States Patent [19]

Adamic

[11] Patent Number: 5,006,862

[45] Date of Patent: Apr. 9, 1991

[54] FIXATION OF REACTIVE DYES TO PAPER BY INK-JET PRINTING

[75] Inventor: Raymond J. Adamic, Corvallis, Oreg.

[73] Assignee: Hewlett-Packard Company, Palo Alto, Calif.

[21] Appl. No.: 429,251

[22] Filed: Oct. 27, 1989

[51] Int. Cl.[5] ..... B41J 2/01

[52] U.S. Cl. ..... 346/1.1; 106/22; 8/543; 346/25; 346/140 R

[58] Field of Search ..... 346/1.1, 75, 140; 8/543; 106/22

[56] References Cited

U.S. PATENT DOCUMENTS

| | | | |
|---|---|---|---|
| 4,419,388 | 12/1983 | Sugiyama | 346/135.1 X |
| 4,538,160 | 8/1985 | Uchiyama | 346/140 |
| 4,599,627 | 7/1986 | Vollert | 346/140 |
| 4,694,302 | 9/1987 | Hackleman | 346/1.1 |

FOREIGN PATENT DOCUMENTS 19583 1/1985 Japan .

*Primary Examiner*—Joseph W. Hartary

[57] ABSTRACT

The water-fastness and smear resistance of prints from inks in which a reactive moiety is attached to a chromophore are improved if the prints are treated with a strong base solution. Preferably, the paper is first treated with the base solution and then printed with the ink.

12 Claims, No Drawings

FIXATION OF REACTIVE DYES TO PAPER BY INK-JET PRINTING

TECHNICAL FIELD

This invention is concerned with the use of reactive dyes in ink-jet printing. More particularly, it involves the fixation of such dyes to paper.

BACKGROUND ART

Ink-jet printers generally use inks that contain water-soluble dyes. Such dyes are often not very smear resistant or water resistant when printed on paper.

The use of colored inks in ink-jet printing is known; for example, U.S. Pat. No. 4,382,262 and U.S. Pat. No. 4,360,548 disclose such systems. These patents, however, do not disclose or suggest forming smear-resistant inks on a substrate, such as paper.

Hackleman and Pawlowski addressed this problem in U.S. Pat. No. 4,694,302. In their method, a polymer is formed on the substrate from two reactive components; one component may be in the ink and the other may be in the substrate or it may be applied from a second reservoir. The resultant polymer binds the dye. In one example, sebacyl chloride was include in the ink; when it was deposited on a cellulose-containing substrate, it formed a cellulosic polymer. In another example, the ink contained carboxymethyl cellulose, and a second solution contained 2% $AlCl_3$. When these solutions were deposited on a substrate, they reacted to form an insoluble salt of the carboxymethyl cellulose polymer.

A method for determining the degree of reactive dye bonding to cellulose is summarized in Dialogue abstract 268024 50-08024. Dyed chromatographic paper is boiled for 5 minutes in distilled water followed by colorimetric determination of the desorbed dye. The summary also notes that the test can be used for the determination of the effects of alkali concentration on the bonding degree.

DISCLOSURE OF THE INVENTION

The method of the present invention uses commercially available reactive dyes as a viable component in ink-jet printing. The reactive dyes have a reactive moiety attached to the chromophore and are capable of forming a covalent bond to a paper substrate. A basic solution of high pH is employed to fix the dye to the paper. The ink containing the reactive dye can be printed before or after the basic solution is applied, but better results are obtained when it is applied afterwards.

DETAILED DESCRIPTION OF THE INVENTION

A reactive dye, such as one having a mono- or dichlorotriazine group or a vinyl sulfone group as the reactive moiety is made into an ink corresponding to the following formulation:

| | |
|---|---|
| reactive dye | about 1 to 10% |
| organic solvent | about 5 to 15% |
| water | about 75 to 94% |
| pH adjusted to | about 5 to 9. |

All percentages herein are by weight.

The organic solvents preferably are 2-pyrrolidone, N-methylpyrrolidone, etc. Glycols and alcohols may be used, especially as a cosolvent with one of the lactams already named.

The pH of the inks is best kept from about 5 to about 9 because of stability considerations. The optimal pH is dependent upon the particular class of reactive moiety in the dye. The more reactive dyes, such as dichlorotriazinyl dyes require milder conditions. In general, the pH should be fairly neutral.

A buffer is used to keep the pH constant so that the reactive dye will not degrade under too acidic or too basic conditions. Buffers which have a buffering capacity in the pH range indicated may employed. If the pH strays beyond this range, it will accelerate the decomposition of the reactive dye; the degree is dependent on the reactivity of the dye.

Preferred ink compositions of this invention correspond to the following formulation, by weight:

| | |
|---|---|
| reactive dye | about 2 to 4% |
| 2-pyrrolidone | about 8 to 12% |
| water | about 84 to 90% |
| pH adjusted to | about 5 to 8. |

In general, the pH of the inks should be fairly neutral, since reactive dyes tend to react with a wide range of materials, including the hydroxyl ion in water. On the other hand, if the ink is too acidic, it is likely to cleave the reactive moiety from the dye molecule.

The inks of this invention generally will contain a biocide. If crusting is a problem, then a humectant can be added.

After solubilization, the ink is printed on paper from an ink-jet cartridge with a thermal ink-jet printer. A second ink-jet cartridge containing a strong base solution, with or without alcohol, is used to fix the ink to the paper. The pH of the base solution should be greater than 10, and the base may be compounds such as NaOH, KOH, LiOH, or amines. Solutions as strong as 1M may be used, although solutions of about 0.1M to about 0.5M NaOH in water are preferred.

Preferably, the base solution will have a pH from about 10 to about 13 and will be applied first, followed by printing with the ink solution. The base breaks up hydrogen bonding in the paper. It causes the paper to swell which helps absorption of the dye. After abstraction of the proton by the base, the cellulosic fiber becomes nucleophilic and is capable of attacking the reactive group of the dye and form a covalent bond. For example, if the paper has been treated with NaOH solution and then printed with a chlorotriazine dye, sodium chloride splits off and leaves the rest of the dye bonded to the cellulose.

If the base solution includes from about 90% to about 100% by weight of an alcohol corresponding to the formula ROH, wherein R is an alkyl radical which has from 1 to about 6 carbon atoms, then the print will dry faster and the amount of wrinkling of the paper is reduced. Typical alcohols are methyl, ethyl, isopropyl, and n-butyl alcohol.

The best method to apply the base and the ink is by dot-on-dot printing. In this method, one applies a dot of base followed by a dot of ink. This ensures that full coverage of base will bind the dye to the paper and minimize print quality defects. The base may be applied after the ink has been laid down without significantly reducing the quality of the print or its fastness, but the result appears to be not quite in the same par as that obtained with printing after the base has been laid down. In either event, the printed paper is allowed to dry.

The invention is particularly useful for printing pure cellulosic papers, such as chromatography paper, or papers which contain cotton content, such as 50% or 25% cotton bond.

The degree of water-fastness can be determined by submerging a sample in water for five minutes and determining the amount of ink which is transferred to the white portion of the paper. Smear resistance is determined by measuring the amount of dye transferred across the white portion of the paper using a conventional highlighter pen. Optical density is measured, using a densitometer.

The present invention provides prints that have high smear resistance and water fastness. As indicated in the following tables, zero smear resistance is obtained as well as low ΔL values. L is a measure of the darkness of the sample; the higher the L value, the lighter the print. A smaller ΔL value after washing between two samples with similar initial L values indicates less dye transferred or lost.

In the claimed process, the dye is bonded to the paper by the base. This is indicated by the following:

1. The hydrolyzed dye does not show the same behavior as the unhydrolyzed dye.
2. The reactive site on the dye is disabled.
3. Water-fast tests done at 100° C. for 10 minutes instead of the normal five minute test at room temperature show only a one unit increase in ΔL.
4. Water based dyestuffs which do not contain reactive moieties show no improvement when used with the base treatment, and solvent induced effects, for example, the effect of a solvent such as 2-pyrrolidone, does not help much in aiding water-fastness when reactive dyes are present in the ink.
5. Drytime is less than 10 seconds with the base treatment, and this is considerably less than drytime without the base treatment.

When a two-pen design is used, the stability of the ink formulation is increased, because the pH of the ink formulation can be set near neutral where stability of the reactive dye is greatest. The invention also permits the use of other curing agents that are suitable for fixation and can possibly be included in the pen. Curing agents may be amines such as ammonia (from about 0.1 to about 0.5M), propylamine, or ethylamine; about 0.1 to about 1M sodium methoxide or sodium ethoxide; sodium bicarbonate or sodium hydroxide. In addition, a two-pen design provides greater versatility in printing; the ink and the alkali may be incorporated into a single compartmentalized unit or two separate units may be used.

EXAMPLES

EXAMPLE 1

Ink formulations containing 2% (A), and 4% (B) Procion MX-CWA (a dichloro-s-triazinylamino dye), and 10% 2-pyrrolidone in water were printed on 100% cellulosic paper from a ink-jet printer. Papers had first been treated in the same alphanumeric pattern with 0.1M NaOH and 0.5M NaOH solutions, respectively.

| Formulation | Treatment | L | ΔL |
|---|---|---|---|
| A1 (pHi = 9.7) | untreated | 58 | 22 |

-continued

| Formulation | Treatment | L | ΔL |
|---|---|---|---|
| A1 | 0.1M NaOH | 58 | 5.3 |
| A1 | 0.1M NaOH (boiled) | 58 | 7.4 |
| | (boiled) = 10 min. in distilled water | | |
| A1 | 0.5M NaOH | 56 | 6.4 |
| A2 (pHi = 9.8) | untreated | 58 | 20.7 |
| A2 | 0.1M NaOH | 57 | 6.7 |
| A2 | 0.5M NaOH | 56 | 6.2 |
| A3 (pHi = 6–7) | untreated | 59 | 21.3 |
| A3 | 0.1M NaOH | 54 | 7.7 |
| A3 | 0.5M NaOH | 56 | 4.6 |
| A4 (pHi = 6.9) | untreated | 57 | 25.1 |
| A4 | 0.1M NaOH/MeOH | 57 | 4.0 |
| A4 | 0.5M NaOH/MeOH | 57 | 4.5 |
| B (pHi = 7.1) | untreated | 49 | 28.1 |
| BP | 0.1M NaOH/MeOH | 49 | 4.3 |
| BP | 0.5M NaOH/MeOH | 49 | 4.6 |

pHi is initial pH; MeOH is 100% methyl alcohol.

EXAMPLE 2

Formulations A3, A4, and B were printed on 50% cotton bond paper. Specimens were treated as indicated below, and water-fastness tested with the following results:

| Formulation | Treatment | L | ΔL |
|---|---|---|---|
| A3 | untreated | 49 | 24.5 |
| A3 | 0.1M NaOH | 54 | 9.3 |
| A3 | 0.5M NaOH | 57 | 5.9 |
| A4 | untreated | 49 | 26.2 |
| A4 | 0.1M NaOH/MeOH | 59 | 6.2 |
| A4 | 0.5M NaOH/MeOH | 58 | 4.7 |
| B | untreated | 40 | 34.5 |
| BP | 0.1M NaOH/MeOH | 52 | 12.3 |
| BP | 0.5M NaOH/MeOH | 52 | 4.9 |

EXAMPLE 3

Formulation A5, which duplicated formulation A4, was printed on 25% cotton bond paper; the paper had been treated as indicated below. The specimens were tested for water-fastness.

| Formulation | Treatment | L | ΔL |
|---|---|---|---|
| A5 | untreated | 47 | 22.2 |
| A5 | 0.1M NaOH/MeOH | 61 | 4.4 |
| A5 | 0.5M NaOH/MeOH | 60 | 3.6 |

EXAMPLE 4

4% Procion Red MX-58 (a dichloro-s-triazinylamino dye) and 10% 2-pyrrolidone were dissolved water and the pH adjusted to 7.4 with aqueous NaOH. Specimens of paper were printed with the formulation after pretreatment with 0.5M NaOH/100% MeOH. The specimens were then tested as indicated.

| Paper | | | | Dye Transfer (mOD) | | Smear Resistance 2-pass (mOD) |
|---|---|---|---|---|---|---|
| Cellulose | | Gilbert | | Gilbert | | |
| L | ΔL | L | ΔL | OD | Dye | Gilbert |
| 55.3 | 4.1 | 57.8 | 4.4 | 0.63 | 30 | 0 |
| When the paper was printed first and then the base was applied, the results were as follows: | | | | | | |
| xx | xx | 52.0 | 5.6 | 0.76 | 111 | 22.4 |
| Untreated paper gave the following results: | | | | | | |

-continued

| Paper | | | | Dye Transfer (mOD) | | Smear Resistance 2-pass (mOD) |
|---|---|---|---|---|---|---|
| Cellulose | | Gilbert | | Gilbert | | |
| L | ΔL | L | ΔL | OD | Dye | Gilbert |
| xx | xx | xx | xx | 0.76 | 351 | 140 |

EXAMPLE 5

4% Procion Red MX-8B, 10% 2-pyrrolidone, in water with pH adjusted to 6.7 gave the following results on Gilbert Bond:

| L | ΔL | Dye Transfer (mOD) | | Smear Resistance 2 pass (mOD) |
|---|---|---|---|---|
| After treatment with 0.5M NaOH/100% MeOH: | | | | |
| 54.3 | 4.3 | oD = 0.72 | 27 | O |
| When the ink was applied first: | | | | |
| 47.84 | 5.1 | oD = 0.87 | 124 | 35.2 |
| When ink was applied first, followed by two treatments with base: | | | | |
| xx | xx | oD = 0.89 | 86 | 33.2 |

EXAMPLE 6

1% Cibacron Black (a monochloro-s-triazinylamino dye) and 10% 2-pyrrolidone water dissolved in water and the pH adjusted to 6.91. When printed on Gilbert Bond that had first been treated with 0.5M NaOH/100% MeOH, a two pass smear resistance test gave an mOD (millioptical) density as measured by densitometer of 16.2 on 50% cotton bond.

INDUSTRIAL APPLICABILITY

The present invention is useful in printing reactive dyes from ink-jet printers. It is particularly useful in printing papers containing cellulosic fibers.

What is claimed is:

1. A process for printing reactive dyes on a medium, comprising:

(a) printing said medium with an ink-jet ink comprising (1) about 1 to 10% of a reactive dye having a reactive moiety, (2) about 5 to 15% of an organic solvent selected from the group consisting of 2-pyrrolidone, N-methyl pyrrolidone, and glycols, and (3) about 75 to 94% water, said ink having a pH adjusted to about 5 to 9; and (b) treating said medium with a basic alcoholic solution containing from about 90% to about 100% alcohol, by weight, of an alcohol having from 1 to 6 carbon atoms, said alcoholic solution having a pH from about 10 to about 13.

2. The process of claim 1 wherein the medium is first printed and then treated.

3. The process of claim 1 wherein the medium is first treated and then printed.

4. The process of claim 1 wherein the reactive dye has a monochlorotriazine group as the reactive moiety.

5. The process of claim 1 wherein the reactive dye has a dichlorotriazine group as the reactive moiety.

6. The process of claim 1 wherein the reactive dye has a vinyl sulfone group as the reactive moiety.

7. The process of claim 1 wherein the medium is a cellulosic material.

8. The process of claim 7 wherein the medium is a cellulosic paper.

9. The process of claim 1 wherein the basic solution is 0.05M to 1M NaOH.

10. The process of claim 1 wherein the alcohol is methyl, ethyl, propyl, or isopropyl alcohol.

11. The process of claim 10 wherein the alcohol is methyl alcohol.

12. The process of claim 1 wherein said ink has the formulation

| | |
|---|---|
| reactive dye | about 2 to 4% |
| 2-pyrrolidone | about 8 to 12% |
| water | about 84 to 90% |
| pH | about 5 to 8. |

* * * * *